US006210234B1

(12) United States Patent
Hsiao et al.

(10) Patent No.: US 6,210,234 B1
(45) Date of Patent: Apr. 3, 2001

(54) CONTACT FOR BOARD TO BOARD CONNECTOR

(75) Inventors: Shihwei Hsiao; Guan-Fu Huang, both of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/469,152

(22) Filed: Dec. 21, 1999

(51) Int. Cl.[7] ..... H01R 12/22
(52) U.S. Cl. ..... 439/631
(58) Field of Search ..... 439/74, 83, 660, 439/637, 636, 631, 630

(56) References Cited

U.S. PATENT DOCUMENTS 5,580,257 * 12/1996 Harwath ..... 439/637
5,620,342 * 4/1997 Kinross ..... 439/637
5,779,507 * 7/1998 Yeh ..... 439/637

* cited by examiner

*Primary Examiner*—Gary F. Paumen
(74) *Attorney, Agent, or Firm*—Wei Te Chung

(57) ABSTRACT

An electrical connector of the present invention comprises an elongate housing having a pair of side walls, a central wall between the side walls defining a number of chambers in opposite rows therealong, and a pair of slots respectively defined between the side walls and the central wall, and a number of contacts received in the chambers. The contacts each have a base, an arcuate beam depending upwardly from the base, and an engaging beam initially continuing upwardly from the arcuate beam. The engaging beam then bends twice to form a lower curved portion and an upper curved portion. Increasing bends of the top curved portion lessens the yielding of the contact. The lower curved portion reduces normal force provided by the connector. Moreover, the contact is secured by interferentially fitting with a side wall and the central wall of the housing.

1 Claim, 4 Drawing Sheets

CONTACT FOR BOARD TO BOARD CONNECTOR

BACKGROUND OF THE INVENTION

1. Field of the Invention

The present invention relates to a connector, and particularly to a surface mounted board to board connector.

2. Brief Description of the Prior Art

U.S. Pat. No. 5,620,342 issued on Apr. 15, 1997 to The Whitaker Corporation, discloses a socket connector. As shown in FIG. 4, the socket connector 6 has an elongate slot 70 defined in a housing 60 thereof for receiving a daughter card and a plurality of contacts 61, 71 spaced apart along the length of the slot 70. Each of the contacts 61 includes a base section 62 interferentially fitting against a side wall 601 and a central rib 602 of the housing 60, an arcuate section 64 angularly extending from the base section 62 and an engaging section 66 extending into the slot 70 upwardly from the arcuate section 64. The contacts 61 and 71 are essentially identical except for the heights of the engaging sections 66 and 76 thereof.

The arcuate section 64 angularly extends from the base section 62 and bends only once, thereby providing a low normal force exerted by the connector 6. However, the connector 6 can not be suitable for low profile applications.

Hence, an improved electrical connector is required to overcome the disadvantages of the prior art.

BRIEF SUMMARY OF THE INVENTION

A first object of the present invention is to provide a connector with a plurality of contacts which provides low normal force and low profile thereof.

To achieve the above-mentioned object, a connector includes an elongate housing having a pair of side walls, a central wall defining two rows of chambers on either side thereof, and a pair of slots respectively defined between the side walls and the central wall, and a plurality of contacts received in the chambers.

The contacts each include a base, an arcuate beam upwardly depending from the base, and a U-shaped engaging beam extending upwardly from the arcuate beam. The arcuate beam bends twice and so forms a lower curved portion and an upper curved portion. The engaging beam extends into the slot and has a top curved portion.

The base forms an inner leg and an outer leg on an upper edge thereof for engaging a side wall of the housing therebetween, thereby securing the contact in the chamber. The inner leg has a plurality of barbs for interferentially engaging with the side wall and the base further forms a bump at an inward surface thereof for interferentially fitting with the central wall, helping to fix the contact in position.

The contact provides low normal force exerted by the engaging beam and is adapted for low profile applications.

Other objects, advantages and novel features of the invention will become more apparent from the following detailed description of the present embodiment when taken in conjunction with the accompanying drawings.

DETAILED DESCRIPTION OF THE INVENTION

Figure 1:
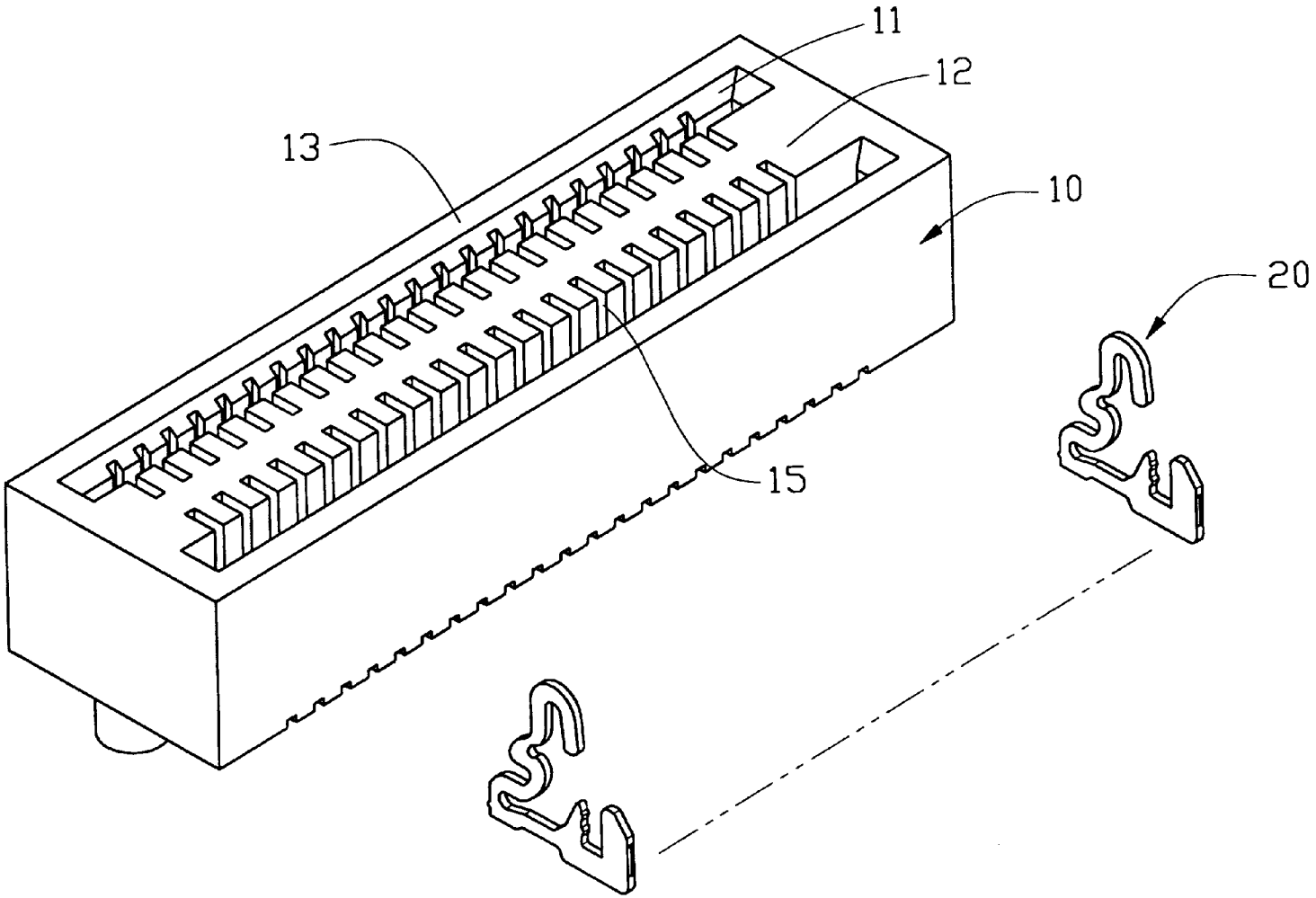
FIG. 1 is an exploded view of an electrical connector of the present invention.

Referring to FIG. 1, an electrical connector 1 of the present invention comprises an elongate dielectric housing 10 and two rows of contacts 20 arrayed longitudinally along the housing 10. The housing 10 has a substrate (not labeled), a pair of side walls 13 upwardly extending from the substrate (not labeled) and an upward central wall 12 interposed between the side walls 13 thereby defining a pair of slots 11 respectively between the central wall 12 and the side walls 13. The slots 11 extend through the substrate (not labeled). The central wall 12 defines opposite pairs of chambers 15 along opposite sides and communicating with a slot 11 thereof for receiving the plurality of contacts 20. Each side wall 13 defines a plurality of recesses 131 in an interior side thereof.

Figure 2:
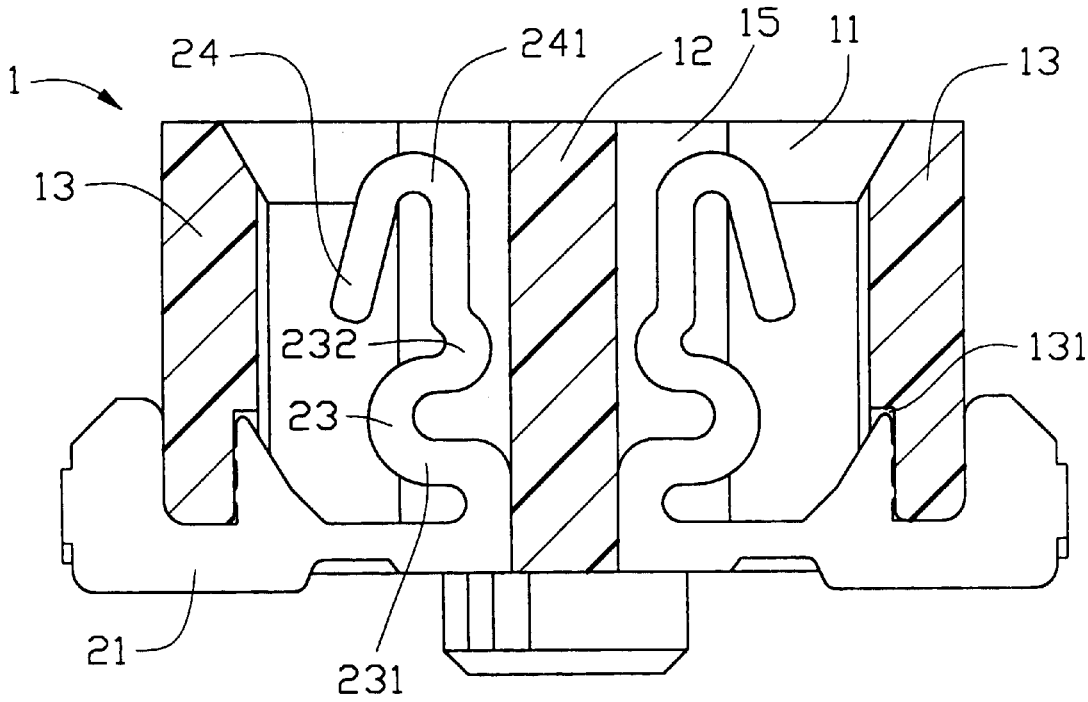
FIG. 2 is a cross-sectional view of the assemble connector of FIG. 1.
Figure 3:
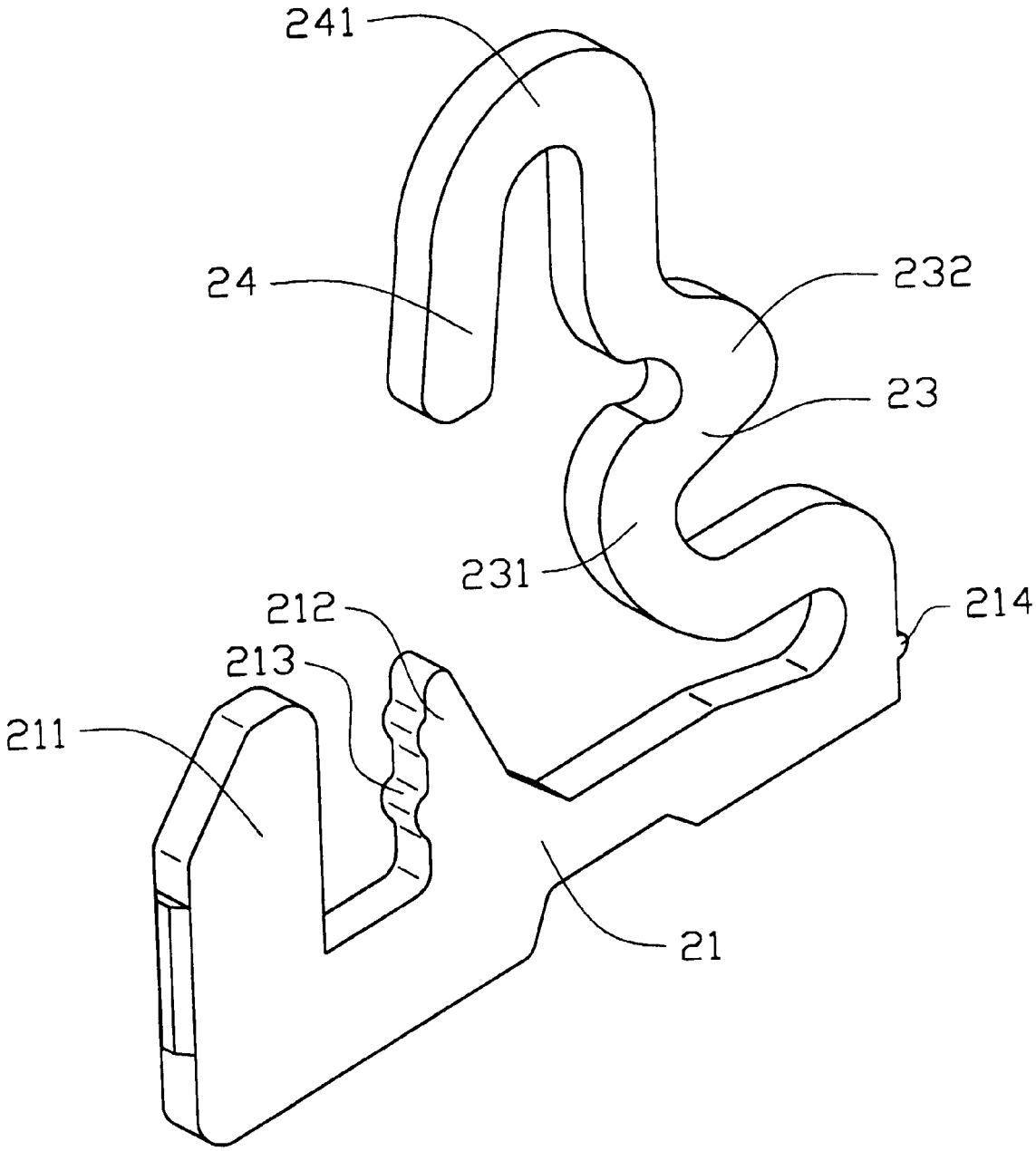
FIG. 3 is a perspective view of one of contacts of the connector of FIG. 1.
Figure 4:
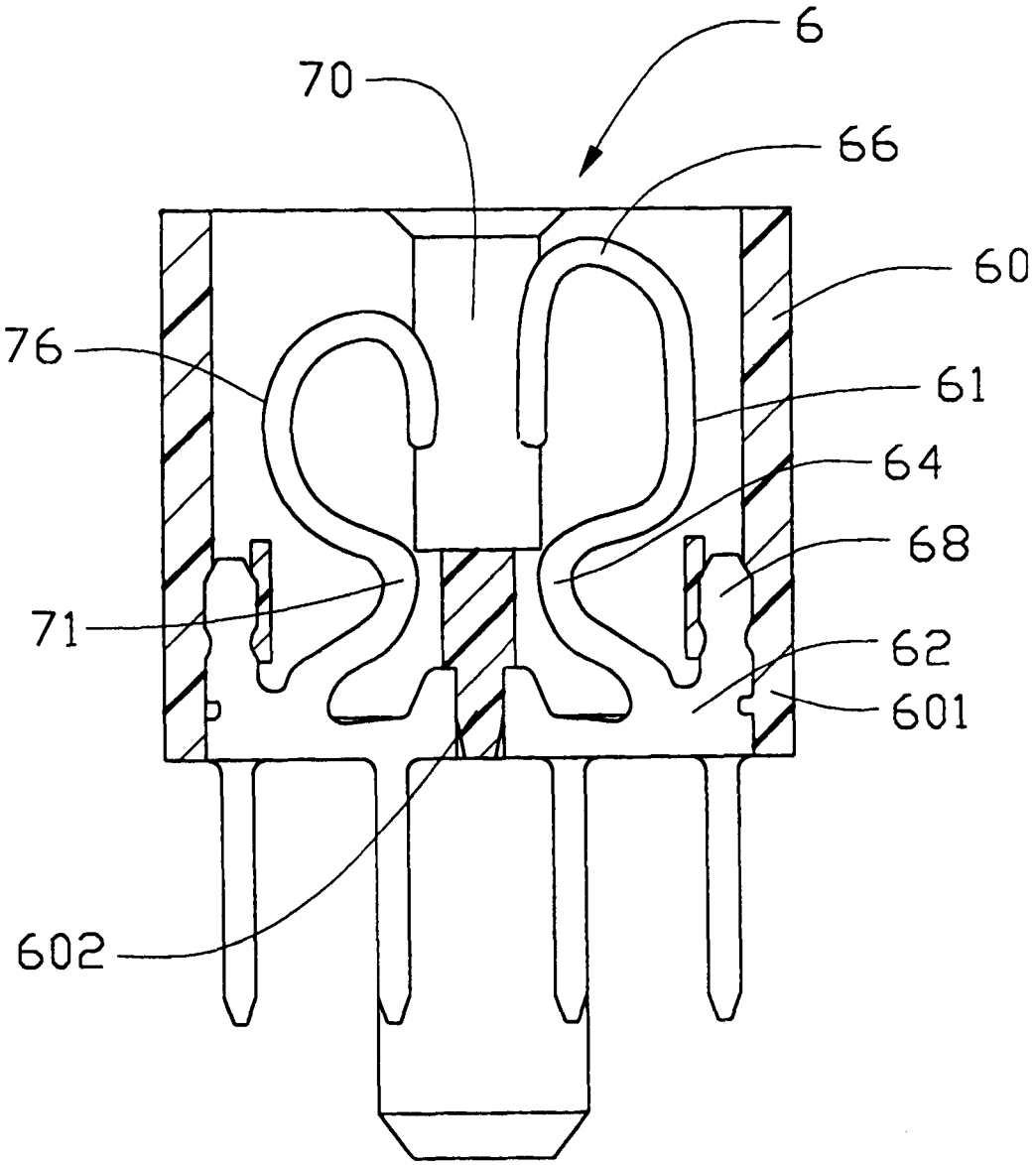
FIG. 4 (PRIOR ART)
FIG. 4 is a cross-sectional view of a prior art connector.

Each contact 20 is stamped from a sheet of metal plate and includes, referring to FIGS. 2 and 3, a base 21, an arcuate beam 23 depending upwardly from the base 21, and a U-shaped engaging beam 24 extending upwardly from the arcuate beam 23 and extending into the slots 11 for electrical connection with a mated plug (not shown).

The base 21 forms an outer leg 211 and an inner leg 212 upwardly projecting therefrom. The inner leg 212 forms a plurality of barbs 213 projecting toward the outer leg 211 on an outward side thereof for interferentially mating with the recess 131. The legs 211 and 212 together engage a side wall 13 therebetween, thereby securing the contact 20 in the chamber 15. The base 21 further forms a bump 214 at an inward surface thereof for interferential fitting with the central wall 12, helping to fix the contact 20 in the chamber 15 of the housing 10.

The arcuate beam 23 initially extends vertically, pressing against the central wall 12 and thus ensuring the rigidity of the contact 20, and then curves twice, thereby forming two curved portions, one being termed a lower curved portion 231 and the other being termed an upper curved portion 232. The bend of the lower curved portion 231 is adjustable during manufacturing allowing the normal force provided by the contact 20 to be adjusted. Increasing the manufactured radius of the lower curved portion 231 reduces the normal force provided by the contact 20 and therefore less mating force is required during engagement with a complementary connector (not shown).

The U-shaped engaging beam 24 has a top curved portion 241 at an apex thereof. The top curved portion 241 defines a radius which can be adjusted during manufacturing to lessen the yielding of the contact 20. Increasing the radius of the top curved portion 241 lessens the yielding of the contact 20.

The contacts 20, in assembly, are inserted into respective chambers 15 from a bottom of the housing 10. The inner legs 212 and the outer legs 211 cooperate to clamp a side wall 13 and the bumps 214 interferentially fit with the central wall 12, thereby securing the contacts 20 in position.

In use, when the terminals of a complementary connector (not shown) are inserted into the slots 11 of the housing 10, they mate with corresponding engaging beams 24 of the contacts 20 of the connector 1. Therefore, the engaging beams 24 outwardly deflect, causing the radiuses of the top curved portions 241 to decrease and the radii of the upper curved portions 232 to increase. Moreover, the radii of the lower curved portions will decrease. The normal force against the complementary connector (not shown) increases.

The mated complementary connector (not shown), therefore, bears a larger normal force than it bears during initial insertion thereby retaining the complementary connector (not shown) in mated connection when an unwanted vibration or withdrawing force occurs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising an insulative housing having a pair of side walls, a central wall which defines two rows of chambers in opposite sides thereof, and a pair of slots defined between each side wall and the central wall, and a plurality of contacts received in the chambers, each contact including a base, an arcuate beam extending upwardly from the base, and an engaging beam extending from the arcuate beam into the slot; the improvement wherein the arcuate beam is bent twice so that a normal force applied to the engaging beam by a mating contact is a function of the individual radii of the bends of the arcuate beam;

wherein the arcuate beam extends perpendicularly from the base;

wherein the arcuate beam forms a lower curved portion and an upper curved portion;

wherein the engaging beam has a top curved portion;

wherein each side wall defines a plurality of recesses at a lower inside thereof;

wherein the base includes an outer leg and an inner leg which clamp the respective side wall therebetween, the inner leg extending into the respective recess and forming a plurality of barbs projecting toward the outer leg for interferential engagement with the side wall;

wherein the base further forms a bump on an inward surface thereof for interferentially mating with the central wall;

wherein the contact is stamped from a sheet of metal blank.

* * * * *